US012123289B2

(12) United States Patent
Greci et al.

(10) Patent No.: US 12,123,289 B2
(45) Date of Patent: Oct. 22, 2024

(54) GENERATED HYDROGEN GAS LIFT SYSTEM

(71) Applicant: Halliburton Energy Services, Inc., Houston, TX (US)

(72) Inventors: Stephen Michael Greci, Little Elm, TX (US); Michael Linley Fripp, Carrollton, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 688 days.

(21) Appl. No.: 16/976,449

(22) PCT Filed: Nov. 7, 2019

(86) PCT No.: PCT/US2019/060308
§ 371 (c)(1),
(2) Date: Aug. 27, 2020

(87) PCT Pub. No.: WO2021/091563
PCT Pub. Date: May 14, 2021

(65) Prior Publication Data

US 2023/0102565 A1 Mar. 30, 2023

(51) Int. Cl.
*E21B 43/12* (2006.01)
*E21B 43/25* (2006.01)

(52) U.S. Cl.
CPC ..... *E21B 43/122* (2013.01); *E21B 43/25* (2013.01)

(58) Field of Classification Search
CPC ..... E21B 43/112; E21B 43/111; E21B 43/12; E21B 43/13; E21B 43/25; E21B 43/122;
(Continued)

(56) References Cited

U.S. PATENT DOCUMENTS 2,748,867 A * 6/1956 Lissant ..... C09K 8/607 507/935
3,164,206 A * 1/1965 Sharp ..... E21B 43/121 166/309

(Continued)

FOREIGN PATENT DOCUMENTS

WO 2016037094 3/2016
WO 2019094044 5/2019

(Continued)

OTHER PUBLICATIONS

International Search Report and Written Opinion issued in corresponding International Application No. PCT/US2019/060308, mailed on Aug. 3, 2020.

*Primary Examiner* — George S Gray
(74) *Attorney, Agent, or Firm* — Barnes & Thornburg LLP

(57) ABSTRACT

A variety of systems, methods and compositions are disclosed, including, in one method, a method for producing a subterranean formation, the method comprising: introducing a reactive material into a wellbore penetrating the subterranean formation; hydrolyzing the reactive material with an aqueous-based wellbore fluid to produce hydrogen gas; reducing a bulk density of the aqueous based wellbore fluid; producing the wellbore. A system for producing a wellbore, the system comprising: an oilfield tubular disposed in a producing wellbore; a fluid column comprising an aqueous based wellbore fluid within the oilfield tubular, wherein the fluid column comprises a hydrostatic head greater than a pore pressure of the wellbore; and a solid reactive material capable of chemically reacting with the aqueous-based wellbore fluid thereby reducing the hydrostatic head.

20 Claims, 1 Drawing Sheet

(58) Field of Classification Search
CPC ..... C22C 21/02; C22C 21/08; C22C 21/14; C22C 21/16; C22C 21/18; C22C 23/02; C22C 23/04
See application file for complete search history.

(56) References Cited

U.S. PATENT DOCUMENTS

| | | | | |
|---|---|---|---|---|
| 4,410,041 | A | 10/1983 | Davies et al. | |
| 5,105,887 | A | 4/1992 | Hewgill et al. | |
| 5,515,924 | A * | 5/1996 | Osterhoudt, III | C09K 8/60 166/309 |
| 9,222,341 | B2 | 12/2015 | Noui-Mehidi | |
| 9,458,704 | B2 | 10/2016 | Al-Mulhem et al. | |
| 9,702,029 | B2 | 7/2017 | Fripp et al. | |
| 9,759,035 | B2 | 9/2017 | Fripp et al. | |
| 10,125,565 | B2 | 11/2018 | Fripp et al. | |
| 10,167,534 | B2 | 1/2019 | Fripp et al. | |
| 2004/0014607 | A1* | 1/2004 | Sinclair | C09K 8/70 507/200 |
| 2011/0290506 | A1* | 12/2011 | Ocalan | E21B 34/00 166/381 |
| 2013/0068462 | A1* | 3/2013 | Pantano | E21B 43/164 166/305.1 |
| 2015/0027722 | A1 | 1/2015 | Al-Mulhem et al. | |
| 2016/0245060 | A1* | 8/2016 | Krumrine | E21B 43/255 |
| 2019/0136667 | A1* | 5/2019 | Zhao | E21B 37/06 |
| 2019/0186248 | A1* | 6/2019 | Sherman | C09K 8/68 |
| 2020/0263078 | A1* | 8/2020 | Bataweel | C09K 8/536 |

FOREIGN PATENT DOCUMENTS

| | | |
|---|---|---|
| WO | 2019245828 | 12/2019 |
| WO | 2020018110 | 1/2020 |
| WO | 2020068037 | 4/2020 |
| WO | 2020171825 | 8/2020 |

* cited by examiner

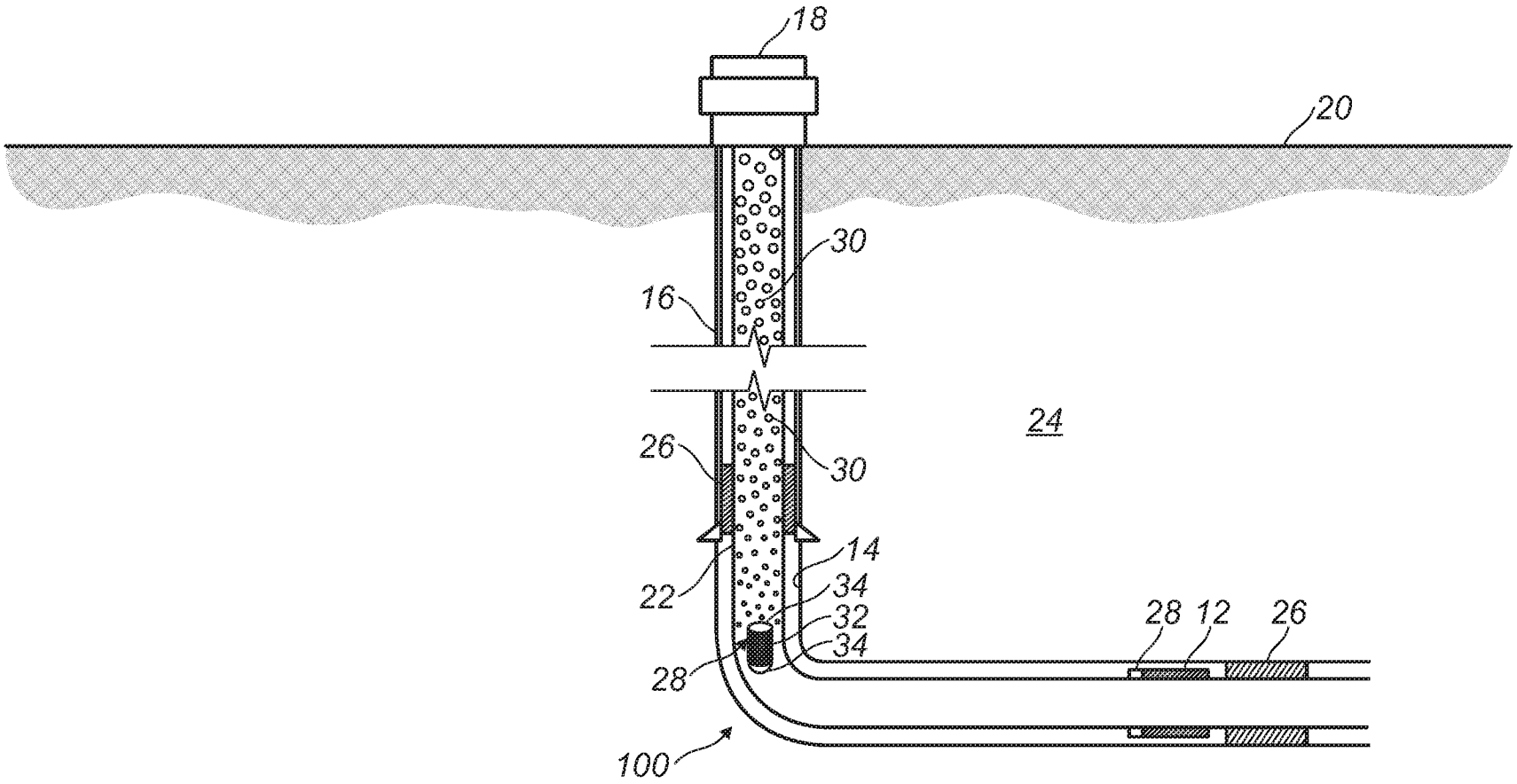
20
18
30
30
16
24
26
22
14
34
32
34
28
28
12
26
100

GENERATED HYDROGEN GAS LIFT SYSTEM

BACKGROUND

At the beginning of the hydrocarbon fluid production cycle, the fluid pressure trapped in the hydrocarbon-bearing formation is operable to drive hydrocarbon fluid to the surface through a pre-formed well bore without additional production assistance. The pressure difference between the fluid head pressure present in the well bore and the pressure of the hydrocarbon fluid in the hydrocarbon-bearing is sufficient to have consistent and predictable production of hydrocarbon fluids from the well bore for a time into the future—potentially years.

Eventually, the pressure in the hydrocarbon-bearing formation diminishes and hydrocarbon fluid production falls. At a certain point, the pressure present in the hydrocarbon-bearing formation is no longer sufficient to produce hydrocarbon fluid at a desirable hydrocarbon fluid flow rate.

BRIEF DESCRIPTION OF THE DRAWINGS

These drawings illustrate certain aspects of some of the systems, methods and compositions of the present disclosure, and should not be used to limit or define the systems, methods and/or compositions.

FIG. 1 illustrates an embodiment of a well system utilizing produced hydrogen gas to bring the well into production.

DETAILED DESCRIPTION

Systems, methods, and compositions are directed to production operations and, in certain systems and methods, to hydrolyze a reactive material in the presence of an aqueous based fluid present in the wellbore thereby generating hydrogen gas bubbles. The hydrogen gas bubbles may lower the bulk density of a fluid column present in the wellbore. In certain embodiments, the bulk density of the fluid column before the hydrolysis reaction begins may range from about 7 pounds per gallon ("ppg") to about 14 ppg, or about 9 ppg to about 13 ppg, or any value or range of values therein. In certain embodiments, the bulk density of the fluid column present in the wellbore after the hydrolysis reaction is completed may range from about 6 ppg to about 13 ppg, or about 0.1 ppg to about 2 ppg reduction from the bulk density of the fluid column prior to the hydrolysis reaction. In certain embodiments, the reactive material may form a non-sealing structure. A non-sealing structure may not form a seal within a portion of the wellbore. Optionally, a non-sealing structure may not support a pressure differential within a wellbore. While the systems, compositions, and methods may be useful in a variety of applications, they may be particularly useful for subterranean well production in order to help initiate production from the wellbore without requiring swapping the fluids within the wellbore.

Reactive materials may comprise dissolvable metals. In certain embodiments, dissolvable metals may comprise, metal, metal alloys, and any combinations thereof. Dissolvable metals may include, but are not limited to, alkaline earth metals, transition metals, and any combinations thereof. Reactive materials may comprise at least one dissolvable metal selected from the group consisting of calcium, magnesium, aluminum, barium, manganese, iron, nickel, copper, zinc, and any combinations thereof. As used herein, "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

Reactive materials may be alloyed to adjust the rate of hydrogen gas released from the reactive material. In a non-limiting example, the reactive material may be a magnesium alloy that may be alloyed with at least one of aluminum, zinc, manganese, zirconium, yttrium, neodymium, gadolinium, silver, calcium, tin, carbon, the like, or any combinations thereof. In another non-limiting example, the reactive material may be an aluminum alloy that may be alloyed with at least one of magnesium, zinc, manganese, copper, silver, calcium, tin, carbon, silicon, the like, or any combinations thereof.

In certain embodiments, reactive materials may further comprise a dopant. The presence of a dopant may promote corrosion and reduce passivation of the reactive metals. Dopants may form intra-granular inclusions or inter-granular inclusions, within the reactive materials, that may promote the production of hydrogen gas bubbles to be produced. In certain embodiments, dopants may minimize the size of the hydrogen gas bubbles produced which may in turn reduce slugging in the treatment fluid. In a non-limiting example, the diameter of the hydrogen gas bubbles produced at each grain may be minimized to about 0.1 inches or less. Any suitable dopant may be used and should not be limited herein. Suitable dopants may include, nickel, iron, copper, carbon, titanium, cobalt, iridium, gold, palladium, gallium, magnesium, the like, or any combinations thereof. Dopants may be present in the reactive metal in a size of about 0.01% by weight to about 25% by weight, or about 0.1% by weight to about 8% by weight, or any value or range of values therein.

Reactive materials may be formed in any suitable manner and should not be limited herein. In certain embodiments, reactive metals may be formed by way of a casting process (also referred to as "a solid solution process"), a powder metallurgy process, an extrusion process, the like, or any combinations thereof.

A casting process may include, obtaining reactive materials that may be in the form of a solid solution. As used herein, the term "solid solution" may refer to a reactive material that may be formed from a single melt where all of the components in the reactive material are melted together in a casting. The casting may then be subsequently extruded, wrought, hipped, or worked. In certain embodiments, at least some of the components of the reactive material may be uniformly distributed throughout the reactive material, although inclusions may also be present, without departing from the spirit and scope of the present disclosure. It is to be understood that some minor variations in the distribution of the reactive material particles may occur, but that it may be preferred that the distribution is such that a homogenous solid solution of the reactive metal may be produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

A powder metallurgy process generally comprises obtaining or producing a fusible reactive material matrix in a powdered form. The powdered fusible reactive material matrix may then be placed in a mold or blended with at least one other type of particle and then placed into a mold. Pressure may be applied to the mold to compact the powder particles together, fusing them to form a solid reactive material which may be used downhole.

Alternatively, the reactive materials may be formed by way of an extrusion process. An extrusion process may comprise obtaining a non-liquefied reactive material and forcing it through a die thereby producing an extruded solid reactive metal for use downhole.

Reactive materials may be of any suitable shape and/or form and should not be limited herein. In a non-limiting example, reactive materials may be formed in the shape of a ball, a rod, a tube, pellets, the like, or any combinations thereof. In certain embodiments, reactive materials may be hollow in form or may have fluid passageways through the body of the reactive material. Alternatively, reactive materials may be solid in form. In certain embodiments, the surface of the reactive metals may be smooth, non-smooth, wavy, uneven, the like, or any combinations thereof. Reactive materials may be of any suitable size including, but not limited to, about 0.1 inch to about 10 inches along a minimum dimension, or any value or range of values therein. Reactive materials may have any suitable surface area including, but not limited to, about 0.05 inches$^2$ to about 500 inches$^2$, or any value or range of values therein. In certain embodiments, reactive materials may have a volume to surface area ratio of about 1 inch$^{-1}$ to about 1000 inch$^{-1}$, or about 7 inch$^{-1}$ to about 100 inch$^{-1}$, or any value or range of values therein. A larger surface area to volume ratio results in a more rapid release of the gas and a reduced likelihood of passivation along the material surface.

In certain embodiments, reactive materials may further comprise coatings. Coatings may be disposed about a least a portion of an outer surface of a reactive material. The coating material may act a protective barrier for the reactive metal from exposure to the formation fluids and environmental conditions until the coating begins to degrade. As the coating begins to degrade, the surface of the reactive metal may be exposed to an aqueous based fluid thereby initiating the hydrolytic degradation of the reactive material. As used herein, the term "hydrolytic degradation" or "hydrolyzing" may refer to a chemical reaction where the reactive material chemically reacts with a water-based fluid and where the reactive material may change form, such as from a metal to a metal hydroxide. As used herein, the terms "degrade," "degradable," and other grammatical variants thereof will refer to any of a variety of breakdown processes through which a material changes its original particulate character or loses its particulate character altogether, including, for example, dissolution, chemical reactivity, melting, or any combination thereof. The coating may have any suitable degradation rate for a given application including, but not limited to, from a delay of about 1 hour to a delay of about 7 days, or any value or range of values therein.

Any suitable coating capable of delaying the hydrolysis reaction of the reactive metal may be used. Suitable coating materials may include, but are not limited to, metal coatings, ceramic coating, polymer coatings, organic coatings, the like, and any combinations thereof. Suitable metal coatings may include, but are not limited to, nickel, gold, silver, titanium, chrome, the like, or any combinations thereof. Suitable ceramic coatings may include, but are not limited to, transition metal oxides, zirconium dioxide, the like, or any combinations thereof. Suitable polymer coatings may include, but are not limited to, rubber, epoxy, plastic, vinyl, polylactic acid, polyglycolic acid, urethane, the like, or any combinations thereof. Suitable organic coatings may include, but are not limited to, sorbitan monooleate, glycerin monoricinoleate, sorbitan monoricinoleate, sorbitanmonotallate, pentaerythritol monoricinoleate, sorbitan monoisostearate, glycerol monostearate, sorbitan monostearate, the like, or any combinations thereof. A coating may be applied to a reactive material in any suitable manner including, but not limited to, physical vapor deposition, chemical vapor deposition, sprayed, dipped, electrodeposited, wetted, auto-catalytic reaction, the like, or any combinations thereof. Optionally, a reactive material may be coated by applying a coating material with a carrier fluid and then evaporating the carrier fluid. In certain embodiments, the carrier fluid may be evaporated via vacuum evaporation.

In a non-limiting example, the reactive material may comprise an anodizing coating or a plasma electrolytic oxidation coating in which the coating may be formed by an oxidizing part of the reactive material. In another non-limiting example, the reactive material may comprise a hydrophobic coating, such as from wax or grease.

In certain embodiments, the reactive material may comprise a plurality of coating layers. In a non-limiting example, the reactive material may be a magnesium based alloy. The magnesium based alloy may be coated with a polyethylene oxide layer. The outer surface of the polyethylene oxide may be coated with a different polymer. When the reactive material was exposed to a potassium chloride brine solution at about 200° F., the coatings provided about a 10-hour delay in degradation.

In a non-limiting example, the reactive metal may comprise a magnesium base alloy with an electroless nickel metal coating. The metal coating may have a residual porosity in the metal ranging from 0.001% to 20%, or any value or range of values therein. The reactive metal may have a delayed degradation of about 18 hours.

Reactive materials may settle within the wellbore by way of gravity alone. In certain embodiments, reactive materials be coupled to settling aids such as pump down darts, weighting agents, the like, or any combinations thereof. Any settling aid capable of aiding in the descent of the reactive material within the wellbore may be used and should not be limited herein. In other embodiments, the reactive materials may be pre-installed along the tubing string prior to the tubing string being introduced into the wellbore Reactive material may be capable of hydrolyzing in the presence of an aqueous-based fluid thereby producing gas bubbles. A reactive material may be hydrolytically degradable in a wellbore environment. As used herein, the term "hydrolytic degradation" refers to the degradation of a material by cleavage of chemical bonds in the presence of an aqueous based fluid. In certain embodiments, the reactive material may be mixed with the aqueous based fluid at the surface of the wellbore and may then be introduced into the wellbore. In certain embodiments, the reactive material may be introduced into the wellbore and may contact an aqueous based fluid within the wellbore. Optionally, the aqueous based fluid and the reactive material may be introduced into the wellbore sequentially or simultaneously. In certain embodiments, the reactive material may contact an aqueous based wellbore fluid. Any suitable aqueous based fluid capable of hydrolytically degrading the reactive material may be used including, but not limited to, fresh water, saltwater (e.g., water containing one or more salts dissolved therein), brine (e.g., saturated salt water), seawater, produced water, wastewater (either treated or untreated), mud (water-based mud or oil-based mud), or any combinations thereof. In certain embodiments, the reactive material may being producing hydrogen gas once the reactive material is close to the heal of the wellbore. In certain embodiments, the reactive material may being producing hydrogen gas soon after contacting the aqueous based fluid, thereby producing hydrogen gas as the reactive material descends within the wellbore. In certain embodiments, reactive material may be introduced into a wellbore in an amount of about 30 pounds to about 10,000 pounds, or about 100 pounds to about 1000 pounds, or any value or range of values therein.

The hydrolyzation rate of reaction for the reactive material may range from about 15 minutes to about 15 days, or about 2 hours to about 36 hours, or any value or range of values therein. As used herein, the hydrolyzation rate of reaction may begin when at least a portion of a surface of the reactive material is exposed to an aqueous based fluid, and terminates when all of the reactive material has hydrolyzed. It may be important to control the hydrolyzation rate of reaction. For example, if the hydrolyzation rate of reaction is too slow, there may not be enough hydrogen gas bubbles in the fluid column at the same time to provide a sufficient decrease in density of the column to reduce the hydrostatic pressure head. Alternatively, if the hydrolyzation rate of reaction is too fast, it may shock the well thereby destabilizing it and the well may come on to production too quickly.

In certain embodiments, a catalysts may be used to adjust the rate of hydrolytic degradation thus adjusting the release rate of the hydrogen gas. Catalysts may be introduced into the wellbore in any suitable manner. In a non-limiting example, the reactive material may be hollow in form, wherein the hollow portion of the reactive material may comprise a catalyst. In another non-limiting example, the catalyst may be mixed with an aqueous based fluid and introduced into a wellbore. Any suitable catalyst capable of increasing the rate of hydrolytic degradation may be used including, but not limited to, an acid, a base, anhydrous acid, a salt, or a chelating agent. In one non-limiting examples, the catalyst may be an anhydrous powder that when hydrolyzed may create hydrochloric acid, the like, or any combinations thereof.

In certain embodiments, the pH of the wellbore fluid may be adjusted to increase or decrease the rate of hydrolytic degradation thus adjusting the release rate of hydrogen gas into a wellbore fluid column. In certain embodiments, decreasing the fluid pH, such as with an organic acid or with an inorganic acid, may accelerate the reaction rate of a magnesium alloy or of an aluminum alloy. In certain embodiments, the pH may be decreased below a pH value of 4 and in other cases it may be decreased below a pH value of 2.

As the reactive material hydrolytically degrades within the wellbore, hydrogen gas bubbles may be formed and released into the wellbore fluid. The hydrogen gas bubbles may provide artificial lift to the wellbore fluid, which may contain hydrocarbon fluids from the hydrocarbon-bearing formation. Hydrogen gas bubbles generated downhole and released into the hydrocarbon fluid may provide artificial lift by expansion, which may reduce the fluid density uphole thereby reducing the fluid column head pressure. Due to the hydrostatic pressure difference between the surface and downhole, the needed volume of product gas generated downhole to achieve artificial lift is very small compared to the needed volume of gas at the surface to compress, inject and pump to the bottom to achieve the same artificial lift.

The produced hydrogen gases generated downhole are more buoyant than the fluids produced by the hydrocarbon-bearing formation. Hydrogen gas bubbles formed downhole may migrate upward towards the surface through the fluid in the wellbore. As the hydrogen gas bubbles traverse upwards, the hydrostatic pressure on the hydrogen gas bubbles may decrease. As the fluid pressure decreases, the volume of the hydrogen gas bubbles may increase. The expanding hydrogen gas bubbles may push against the wellbore fluid. In addition, the hydrogen gas bubbles may occupy a larger percentage of a given volume of wellbore fluid/hydrogen gas bubbles as the fluid/hydrogen gas combination approaches the surface. The wellbore fluid may become less dense as it approaches the surface. The decline in fluid density may in turn cause a reduction in total hydrostatic head pressure, which may permit greater fluid flow and hydrocarbon production from the hydrocarbon-bearing formation.

Hydrogen gas bubbles may be used to reduce the total hydrostatic head pressure of a wellbore at any point during the life of the well. In certain embodiments, hydrogen gas bubbles may be used when it is desired to bring the well onto production thereby extracting hydrocarbons from the hydrocarbon bearing formation. In certain embodiments, additional recovery techniques may be used to bring the well into production. Several production stages may be used in the process of extracting hydrocarbons from a reservoir in a subterranean formation. "Primary production" (which may also be referred to as "primary recovery") is the first stage of hydrocarbon production, in which natural reservoir energy, such as gas-drive, water-drive, or gravity drainage may be used to displace hydrocarbons from a reservoir and into a wellbore for production to the surface. In certain embodiments, an artificial lift system may be implemented from the wellbore adjacent to the production zone to the wellhead, such as a rod pump, an electrical submersible pump, a gas-life installation, and the like. Production to the wellhead by natural reservoir energy or using artificial life may be considered primary production. The primary production stage may be considered ended either when the reservoir pressure is so low that the production rates are not economical, or when the proportions of undesirable gas or water in the production stream are too high.

The next stage of production is termed "secondary production" (which may also be referred to as "secondary recovery"). Secondary production requires reservoir injection, such as water flooding techniques, to displace hydrocarbons from the reservoir and into the wellbore. One or more injection wells located adjacent to the production wellbore may be utilized in such injection techniques.

The third stage of production is termed "tertiary production" or "enhanced oil recovery" ("EOR") (which may be referred to as "tertiary recovery"). Although EOR techniques may be used after the secondary production stage, they may also be initiated at any time during the productive life of an oil reservoir (i.e., during either of the primary production, secondary production, or thereafter). EOR techniques may restore formation pressure and improve oil displacement or fluid flow in the reservoir toward the wellbore. EOR techniques may result in the production of about 10 to about 60%, or more, of a reservoir's original hydrocarbons in place.

Example methods of introducing a reactive material into a wellbore to produce hydrogen gas thereby starting and/or increasing production of fluids will now be described in more detail with reference to FIG. 1. Any of the previous examples of generated gas may apply in the context of FIG. 1. It should be noted that while FIG. 1 generally depicts a land-based operation, those skilled in the art will readily recognize that the principles described herein are equally applicable to subsea operations that employ floating or sea-based platforms and rigs, without departing from the scope of the disclosure.

FIG. 1 illustrates an embodiment of well system 100 in an open hole completion configuration. The well system 100 is shown as a horizontal well, having a wellbore 14 that deviates to horizontal or substantially horizontal in a subterranean zone of interest 24. A type of oilfield tubing, referred to as casing 16, is cemented in the wellbore 14 and coupled to a wellhead 18 at the surface 20. The casing 16 extends only through the vertical portion of the wellbore 14. The remainder of the wellbore 14 is completed open hole (i.e., without casing). A oilfield tubing string 22 extends from wellhead 18, through the wellbore 14 and into the subterranean zone of interest 24. The oilfield tubing string 22 can take many forms, for example, as a continuous tubing string between the subterranean zone 24 and the wellhead 18, as a length of production liner coupled to the casing 16 at a liner hanger with a tieback liner extending from the liner hanger to the wellhead 18, and/or another configuration. A packer 26 seals the annulus between the production string 22 and the casing 16. Additional packers 26 can be provided between the screen assemblies 12 to seal the annulus between the wellbore wall and the oilfield tubular string 22.

The oilfield tubular string 22 may operate in producing fluids (e.g., oil, gas, and/or other fluids) from the subterranean zone 24 to the surface 20. In certain instances, the production string 22 may also be used in injecting reactive materials 28 and/or fluids (e.g., acid and/or other fluids) into wellbore 14 and into the subterranean zone 24. In a non-limiting example, reactive material 28 may be in the form of a hollow cylinder, wherein the inner diameter of the hollow cylinder may comprise a powdered acid 32. Reactive material 28 may comprise caps 34, wherein caps 34 may be substantially thinner that the walls of the reactive metal 28. The production string 22 may include one or more well screen assemblies 12. In some instances, the annulus between the production string 22 and the open hole portion of the wellbore 14 may be packed with gravel and/or sand. The well screen assemblies 12 and gravel/sand packing may allow communication of fluids between the subterranean zone 24 and the interior of the production string 22. The gravel/sand packing may provide a first stage of filtration against passage of particulate and larger fragments of the formation to the production string 22. The well screen assemblies 12 may provide a second stage of filtration, and are configured to filter against passage of particulate of a specified size and larger into the interior center bore production string 22. One or more of the well screen assemblies 12 may be provided with a flow control device 28 that controls flow through the well screen assembly 12, between the bore of the production string 22 and the subterranean zone 24.

In certain embodiments, reactive material 28 may be introduced into the wellbore 14. In a non-limiting example, reactive material 28 may be weighted to aid in the decent of the reactive material 28 in the wellbore 14. In certain embodiments, the reactive material 28 may be coupled to a pump down dart and may be pumped down into the wellbore 14. Optionally, reactive material 28 may be introduced into the wellbore 14 without additional components to aid in the descent of the reactive material 28 within the wellbore 14. After the reactive material 28 reaches a certain point within wellbore 14, reactive material 28 may begin to hydrolyze thereby producing hydrogen gas bubbles 30. Hydrogen gas bubbles 30 may flow from the reactive material 28 towards the surface 20 of the wellbore 14. As the hydrogen gas bubbles 30 rise through the wellbore fluid, the hydrogen gas bubbles 30 may expand in volume and may decrease the density of the wellbore fluid. This may in turn reduce the total hydrostatic head pressure of the wellbore 14 thereby bringing the well system 100 onto production.

In certain embodiments, the hydrolysis reaction may produce a fine powder substance within wellbore 14. The fine powder substance may be mixed with the produced fluids and may be produced at the surface 20 of wellbore 14. The fine powder substance may be further removed from the wellbore through the use of coiled tubing.

The exemplary reactive materials disclosed herein may directly or indirectly affect one or more components or pieces of equipment associated with the preparation, delivery, recapture, recycling, reuse, and/or disposal of the reactive materials. For example, the reactive materials may directly or indirectly affect one or more mixers, related mixing equipment, mud pits, storage facilities or units, composition separators, heat exchangers, sensors, gauges, pumps, compressors, and the like used to generate, store, monitor, regulate, and/or recondition the sealant composition. The reactive materials may also directly or indirectly affect any transport or delivery equipment used to convey the treatment fluid particulates to a well site or downhole such as, for example, any transport vessels, conduits, pipelines, trucks, tubulars, and/or pipes used to compositionally move the treatment fluid particulates from one location to another, any pumps, compressors, or motors (e.g., topside or downhole) used to drive the treatment fluid particulates into motion, any valves or related joints used to regulate the pressure or flow rate of the reactive materials (or fluids containing the same reactive materials), and any sensors (i.e., pressure and temperature), gauges, and/or combinations thereof, and the like. The disclosed reactive materials may also directly or indirectly affect the various downhole equipment and tools that may come into contact with the reactive materials such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Accordingly, this disclosure describes systems, methods, and compositions that may relate to subterranean operations. The systems, methods, and compositions may further be characterized by one or more of the following statements:

Statement 1: A method for producing a subterranean formation, the method comprising: introducing a reactive material into a wellbore penetrating the subterranean formation; hydrolyzing the reactive material with an aqueous-based wellbore fluid to produce hydrogen gas; reducing a bulk density of the aqueous based wellbore fluid; producing the wellbore.

Statement 2: The method of statement 1, wherein reducing the bulk density further comprises allowing the hydrogen gas to expand as the hydrogen gas flows through the aqueous based wellbore fluid towards a surface of the wellbore.

Statement 3: The method of statement 1 or 2, wherein the bulk density of the aqueous based wellbore fluid is reduced to by at least 0.1 pound per gallon.

Statement 4: The method of any of the preceding statements, wherein the reactive material is a dissolvable metal selected from the group consisting of metal, metal alloy, and any combination thereof.

Statement 5: The method of any of the preceding statements, wherein the dissolvable metal comprises at least one material selected from the group consisting of calcium, magnesium, aluminum, barium, strontium, scandium, titanium, vanadium, chromium, manganese, iron, cobalt, nickel, copper, zinc, yttrium, zirconium, niobium, molybdenum, rhodium, palladium, silver, cadmium, hafnium, tantalum, tungsten, rhenium, osmium, iridium, platinum, gold, and any combination thereof.

Statement 6: The method of any of the preceding statements, wherein the reactive material further comprises an at least one dopant selected from the group consisting of nickel, iron, copper, carbon, titanium, cobalt, iridium, gold, palladium, gallium, magnesium, and any combination thereof.

Statement 7: The method of any of the preceding statements, wherein the reactive material further comprises a coating selected from the group consisting of a metal coating, a polymeric coating, a ceramic coating, an organic coating, and any combination thereof.

Statement 8: The method of any of the preceding statements, wherein the coating is selected to delay hydrolysis for a time period of about 1 hour to about 36 hours after entering the wellbore.

Statement 9: The method of any of the preceding statements, wherein the hydrogen gas is continuously produced for about 15 minutes to about 2 days after the reactive material begins to hydrolyze.

Statement 10: The method of any of the preceding statements, wherein the reactive material has a shape selected from at least one of a ball, a rod, a tube, and any combinations thereof.

Statement 11: The method of any of the preceding statements, wherein the reactive material has a volume to surface area ratio greater than about 7 $inch^{-1}$ to about 1000 $inch^{-1}$ before hydrolysis begins.

Statement 12: The method of any of the preceding statements, wherein a rate of hydrolysis is proportional to a surface area of the reactive material, wherein the reactive material hydrolyzes at a rate of about 15 minutes to about 15 days.

Statement 13: The method of any of the preceding statements, wherein the method further comprises: allowing the reactive material to hydrolyze, wherein hydrolysis of the reactive material produces a powder residue within the wellbore; and producing the powder residue in the wellbore to a surface of the wellbore.

Statement 14: The method of any of the preceding statements, wherein the reactive material is a non-sealing structure.

Statement 15: A system for producing a wellbore, the system comprising: an oilfield tubular disposed in a producing wellbore; a fluid column comprising an aqueous based wellbore fluid within the oilfield tubular, wherein the fluid column comprises a hydrostatic head greater than a pore pressure of the wellbore; and a solid reactive material capable of chemically reacting with the aqueous-based wellbore fluid thereby reducing the hydrostatic head.

Statement 16: The system of statement 15, wherein the reactive material comprises an at least one metal selected from the group consisting of calcium, magnesium, aluminum, barium, manganese, iron, nickel, copper, zinc, and any combinations thereof, and any combination thereof.

Statement 17: The system of statement 15 or 16, wherein the reactive material hydrolyzes to produce hydrogen gas, wherein the hydrogen gas reduces the bulk density of the aqueous based wellbore fluid as it flows towards a surface of the wellbore.

Statement 18: The system of any of the preceding statements, wherein the reactive material further comprises an at least one dopant selected from the group consisting of nickel, iron, copper, carbon, titanium, cobalt, iridium, gold, palladium, gallium, magnesium, and any combination thereof.

Statement 19: The system of any of the preceding statements, wherein the reactive material further comprises a coating selected from the group consisting of a metal coating, a ceramic coating, a polymer coating, an organic coating, and any combinations thereof.

Statement 20: The system of any of the preceding statements, wherein the reactive material has a volume to surface area ratio of about 1 $inch^{-1}$ to about 1000 $inch^{-1}$ before hydrolysis begins.

To facilitate a better understanding of the present disclosure, the following examples of certain aspects of some of the systems, methods and compositions are given. In no way should the following examples be read to limit, or define, the entire scope of the disclosure.

EXAMPLE 1

A reactive material comprising an alloy of magnesium could be used to stimulate a wellbore. Consider that the reactive material was introduced into a wellbore comprising a hydrostatic head pressure of about 3,000 psi at a temperature of about 250° F. About 1,000 lbs of reactive material could be introduced into the wellbore which would create about 82.5 lbs of hydrogen gas. At standard temperature and pressure, the volume of the released hydrogen gas is about 15 MSCF. The magnesium is alloyed with a dopant of higher galvanic potential so that the material degrades and may release the hydrogen over a 24 hour period which would result in an equivalent gas injection rate of 15 MSCF per day. Hydrochloric acid may be used to accelerate the conversion from magnesium alloy into hydrogen gas. The wellbore fluid may be acidified to a pH of 2 then the reaction rate may increase by approximately 100 times. The gas would be released over ¼ hour which may result in an equivalent gas injection rate of 1500 MSCF per day.

Therefore, the present disclosure is well adapted to attain the ends and advantages mentioned as well as those that are inherent therein. The particular systems, methods and compositions disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative systems, methods and cement compositions disclosed above may be altered or modified and all such variations are considered within the scope and spirit of the present disclosure. While compositions and methods are described in terms of "comprising," "containing," "having," or "including" various components or steps, the compositions and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−25% of each numerical value. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

What is claimed is:

1. A method for producing a subterranean formation, the method comprising:

introducing a reactive material into a wellbore penetrating the subterranean formation; wherein the reactive material comprises a coating formed by oxidizing a portion of the reactive material;

hydrolyzing the reactive material with an aqueous-based wellbore fluid to produce hydrogen gas;

adjusting a pH of the aqueous-based wellbore fluid to alter a rate of the hydrolyzing the reactive material;

reducing a bulk density of the aqueous-based wellbore fluid;

producing the wellbore.

2. The method of claim 1, wherein reducing the bulk density further comprises allowing the hydrogen gas to expand as the hydrogen gas flows through the aqueous based wellbore fluid towards a surface of the wellbore.

3. The method of claim 1, wherein the bulk density of the aqueous based wellbore fluid is reduced by at least 0.1 pound per gallon.

4. The method of claim 1, wherein the reactive material is a dissolvable metal selected from the group consisting of metal, metal alloy, and any combination thereof.

5. The method of claim 4, wherein the dissolvable metal comprises at least one material selected from the group consisting of calcium, magnesium, aluminum, barium, strontium, scandium, titanium, vanadium, chromium, manganese, iron, cobalt, nickel, copper, zinc, yttrium, zirconium, niobium, molybdenum, rhodium, palladium, silver, cadmium, hafnium, tantalum, tungsten, rhenium, osmium, iridium, platinum, gold, and any combination thereof.

6. The method of claim 1, wherein the reactive material further comprises an at least one dopant selected from the group consisting of nickel, iron, copper, carbon, titanium, cobalt, iridium, gold, palladium, gallium, magnesium, and any combination thereof.

7. The method of claim 1, wherein the reactive material further comprises an additional coating selected from the group consisting of a metal coating, a polymeric coating, a ceramic coating, an organic coating, and any combination thereof.

8. The method of claim 7, wherein the coating is selected to delay hydrolysis for a time period of about 1 hour to about 36 hours after entering the wellbore.

9. The method of claim 1, wherein the hydrogen gas is continuously produced for about 15 minutes to about 2 days after the reactive material begins to hydrolyze.

10. The method of claim 1, wherein the reactive material has a shape selected from at least one of a ball, a rod, a tube, and any combinations thereof.

11. The method of claim 1, wherein the reactive material has a surface area to volume ratio greater than about 7 inch-1 to about 1000 inch-1 before hydrolysis begins.

12. The method of claim 11, wherein a rate of hydrolysis is proportional to a surface area of the reactive material, wherein total dissolution of the reactive material occurs in a time of about 15 minutes to about 15 days.

13. The method of claim 1, wherein the method further comprises:

allowing the reactive material to hydrolyze, wherein hydrolysis of the reactive material produces a powder residue within the wellbore; and producing the powder residue in the wellbore to a surface of the wellbore.

14. The method of claim 1, wherein the reactive material is a non-sealing structure.

15. A system for producing a wellbore, the system comprising:

an oilfield tubular disposed in a producing wellbore;

a fluid column comprising an aqueous based wellbore fluid within the oilfield tubular, wherein the fluid column comprises a hydrostatic head greater than a pore pressure of the wellbore; wherein a pH of the aqueous-based wellbore fluid is configured to be adjusted;

and a solid reactive material capable of chemically reacting with the aqueous-based wellbore fluid thereby reducing the hydrostatic head; wherein the adjustment of the pH of the aqueous-based wellbore fluid results in the altering of a rate of the chemical reaction of the aqueous-based wellbore fluid with the solid reactive material; wherein the reactive material comprises a coating formed by oxidizing a portion of the reactive material.

16. The system of claim 15, wherein the reactive material comprises an at least one metal selected from the group consisting of calcium, magnesium, aluminum, barium, manganese, iron, nickel, copper, zinc, and any combination thereof.

17. The system of claim 15, wherein the reactive material hydrolyzes to produce hydrogen gas, wherein the hydrogen gas reduces the bulk density of the aqueous based wellbore fluid as the aqueous based wellbore fluid flows towards a surface of the wellbore.

18. The system of claim 15, wherein the reactive material further comprises an at least one dopant selected from the group consisting of nickel, iron, copper, carbon, titanium, cobalt, iridium, gold, palladium, gallium, magnesium, and any combination thereof.

19. The system of claim 15, wherein the reactive material further comprises an additional coating selected from the group consisting of a metal coating, a ceramic coating, a polymer coating, an organic coating, and any combinations thereof.

20. The system of claim 15, wherein the reactive material has a surface area to volume ratio of about 1 inch-1 to about 1000 inch-1 before hydrolysis begins.

* * * * *